United States Patent [19]

Kleemann et al.

[11] 4,082,548

[45] Apr. 4, 1978

[54] HIGHCREEP-RESISTANT COBALT-BASE ALLOY

[75] Inventors: Willi Kleemann, Media; Cyril G. Beck, Monroeville, both of Pa.

[73] Assignee: Westinghouse Electric Corporation, Pittsburgh, Pa.

[21] Appl. No.: 595,642

[22] Filed: Jul. 14, 1975

[51] Int. Cl.[2] ..... C22C 19/07

[52] U.S. Cl. ..... 75/171; 148/32

[58] Field of Search ..... 75/171, 170; 148/32, 148/32.5

[56] References Cited

U.S. PATENT DOCUMENTS

| | | | |
|---|---|---|---|
| 3,432,294 | 3/1969 | Wheaton | 75/171 |
| 3,960,552 | 6/1976 | Woulds | 75/171 |

*Primary Examiner*—R. Dean

*Attorney, Agent, or Firm*—R. T. Randig

[57] ABSTRACT

A cobalt-base alloy particularly for the cast parts of gas engines which operate at high temperatures, such as stationary blades of turbines, vanes of large cross-sectional and the like. The alloy has the minimum practicable of zirconium so that detrimental inter-dendritic carbide oxidation is suppressed. The surface of castings of this alloy readily lend themselves to coating with oxidation and sulfidation resistant coatings. In addition, the carbide oxidation attack of the crucible in which the alloy is melted or molded is minimized so that the economy of producing castings is materially improved. Also, improved is the internal structure of the investment castings produced in normal shop practice; i.e., equiaxed grain size, as distinct from columnar grain size, is produced and this results in an increase in the integrity of cast properties in large castings. The creep resistance of the alloy is further improved by including a small but effective quantity of aluminum in the composition cooling conditions for the casting of this alloy are less critical than for prior art alloys; finer dentrite arm spacings can be obtained under normal current casting shop processes.

1 Claim, 17 Drawing Figures

SUPERHEAT CRUCIBLE TEMPERATURE

MOLD TEMPERATURE

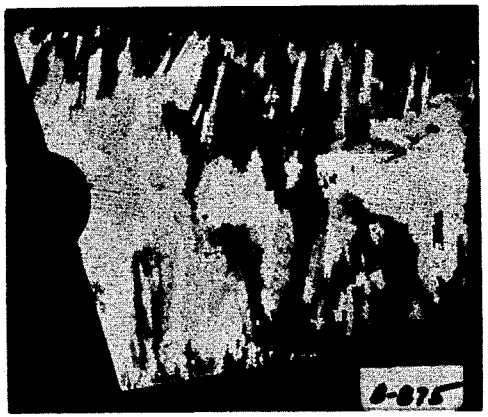
FIG.6D
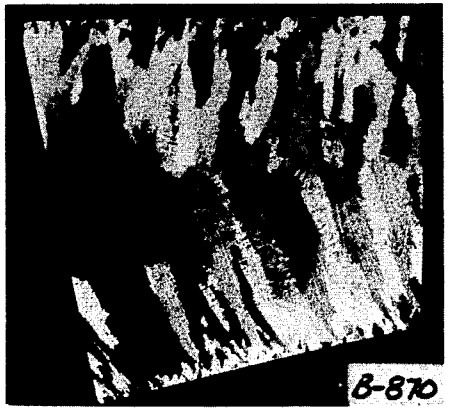
FIG.6B
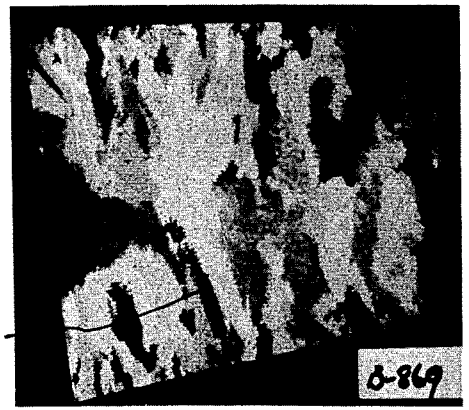
FIG.6C
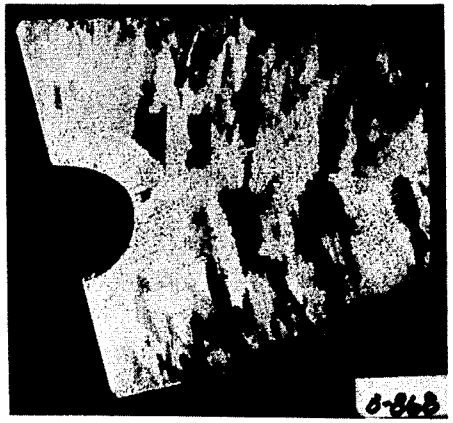
FIG.6A
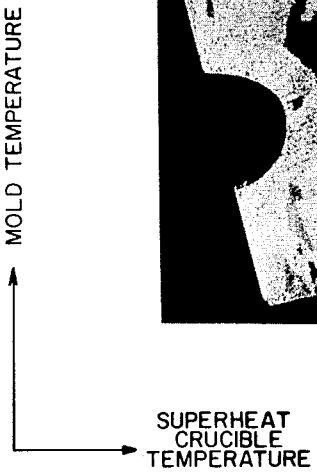

HIGHCREEP-RESISTANT COBALT-BASE ALLOY

REFERENCE TO RELATED DOCUMENTS

1. U.S. Pat. No. 3,432,295 - Mar. 11, 1969, Wheaton.
2. H. L. Wheaton - MAR-M 509, A New Cast Cobalt Base Alloy For High-Temperature Service - COBALT December 29, 1965, - pp. 1–8.
3. P. S. Kotval - Carbide Precipitation On Imperfections in Superalloy Matrices - Transactions of the Metallurgical Society of AIME — Vol. 242 August 1968 pp. 1651–1656.
4. Michael J. Woulds and Thomas R. Cass - Recent Developments in MAR-M Alloy 509 - COBALT 42 — March 1969 — pp. 3–13.
5. A. M. Beltran, C. T. Sims, N. T. Wagenheim - The High Temperature Properties of MAR-M Alloy 509 - Journal of Metals September 1969 pp. 39–47.
6. M. J. Woulds - Casting of Cobalt - Base Superalloys -Metals Engineering Quarterly - American Society of Metals - May 1969 - pp. 42–45.
7. S. S. Manson - Aerospace Structures Metals Handbook - June 1973.

BACKGROUND OF THE INVENTION

This invention relates to the alloy art and has particular relationship to cobalt-base alloys particularly suitable for use in apparatus operating at high temperature typically at 1500° F to 1900° F. Typical of such apparatus are the parts of gas-turbines such as the stationary blades and the vanes of large cross section typically of about 1 inch maximum thickness. Such blades and vanes are produced by investment casting. The alloy is molten in a crucible and poured into a mold. The molded structure is coated with an oxidation-sulfidation resistant coating. Typical of the prior art are the alloys disclosed in Wheaton U.S. Pat. No. 3,432,294 and discussed in the documents listed above. In the use of the Wheaton and like alloys the difficulty has been experienced that the surface carbide is oxidized. The surface of the molded article then has oxidized areas and the oxidation-sulfidation resistant coating cannot be applied effectively to such areas. In addition the affinity to oxidation of the surface carbide causes the alloy to attack and act with the crucible in which it is molten and the mold excessively and the result is inclusive in the castings request renewal of the crucible and mold at substantial cost is required.

The parts operating at high temperatures which are composed of the Wheaton alloy require high creep-rupture strength and to achieve this high creep-rupture strength the Wheaton alloy includes, among the elements of which it is composed, zirconium and titanium. Typically, there is 0.1% to 1% zirconium and 0.1% to 0.5% titanium. Attempts have been made to reduce the surface-carbide oxidation by reducing the zirconium in the alloy but this has failed to entirely eliminate the oxidation and its attendant difficulties.

It is an object of this invention to overcome the above-described difficulties of the prior art and to provide a cobalt-base alloy for use in casting parts of apparatus that operate at high temperatures which alloy shall have high creep resistance at the high temperatures and in the fusing and molding of which detrimental surface-carbide oxidation shall not occur.

SUMMARY OF THE INVENTION

In accordance with this invention the surface-carbide oxidation is eliminated or reduced to the extent that it is not detrimental by reducing to the extent practicable the zirconium in the composition. According to the invention a high creep-resistance cobalt-base alloy is provided in which the zirconium is maintained at the barest minimum, specifically less than 0.05%. The cobalt-base alloy according to this invention includes a substantial proportion of tungsten and of tantalum. It has been found that zirconium is introduced as an impurity both with the tungsten and with the tantalum. In the practice of this invention the tungsten and tantalum included in the alloy are so produced as to minimize the zirconium. It has been found that in the casting of the alloy according to this invention detrimental surface-carbide oxidation, brought about by metalmold reaction, is not manifested. The parts cast from this alloy can be successfully and completely coated with oxidation-sulfidation resistant coatings and do not show premature failure during service because of the presence of sub-surface oxidation products. The internal structure of the investment castings is also improved. The crucibles which are used in fusing this alloy are not deteriorated by the oxidation reactions. The oxidation, in the case of the prior art alloys, produces slag in the crucible requiring frequent replacement and involving down time. The alloy avails substantial savings.

Creep strength and ductility tests of the alloy according to this invention reveal that this alloy has as high creep resistance as the Wheaton alloy at lower temperatures about 1500° F or 1600° F but suffers a slightly reduced creep resistance at higher temperatures, about 2000° F.

It has been discovered that the creep resistance is improved by including in the composition a small but effective quantity of aluminum, usually between 0.15% and 0.25%.

BRIEF DESCRIPTION OF THE DRAWINGS

For a better understanding of this invention, both as to its organization and as to its method of operation, together with additional objects and advantages thereof, reference is made to the following descriptions taken in connection with the accompanying drawings, in which:

FIG. 4 is a view in side elevation showing the manner in which a vane produced with the alloy according to this invention is sectioned to determine metal mold reaction, porosity, intergranular attack and the like.

FIGS. 6A, B, C, D, are grain photographs, about 5 magnification, of cross sections of an airfoil or vane cast of a commercial Wheaton alloy;

DETAILED DESCRIPTION OF INVENTION

For the manufacture of precision investment castings, such as turbine vane segments, the charge is vacuum melted to approximately 300° F above its melting point and then cast into a preheated investment mold which was initially preheated to approximately 1900° F. Following pouring, the mold is removed from the vacuum chamber and cooled to room temperature in still air.

Figure 1:
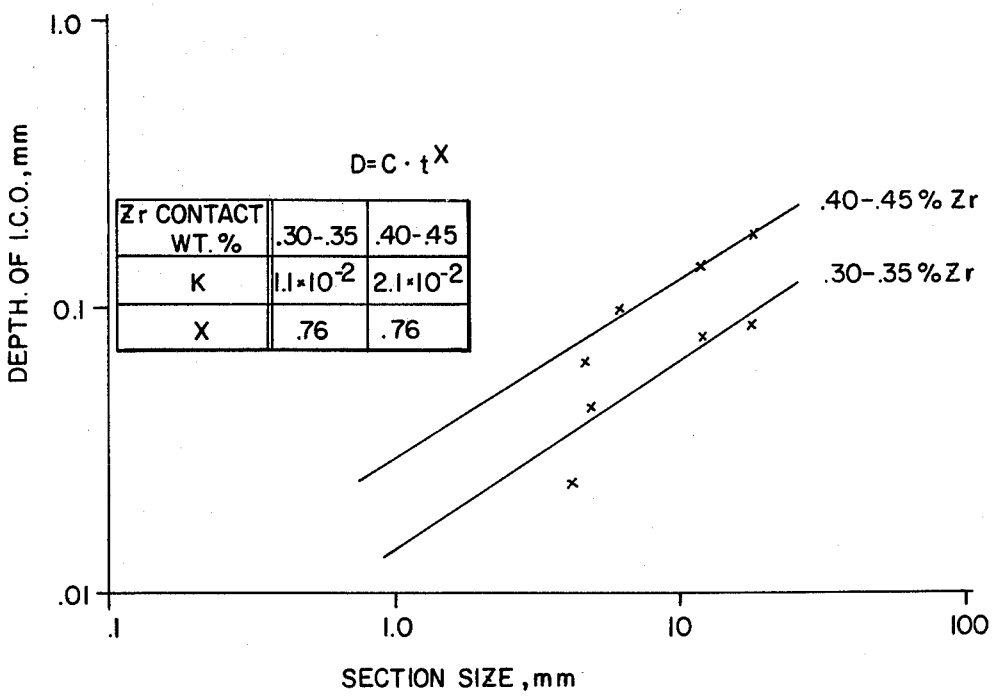
FIG. 1 is a graph showing the effect of zirconium on depth of intercarbide oxidation.
Figure 1A:
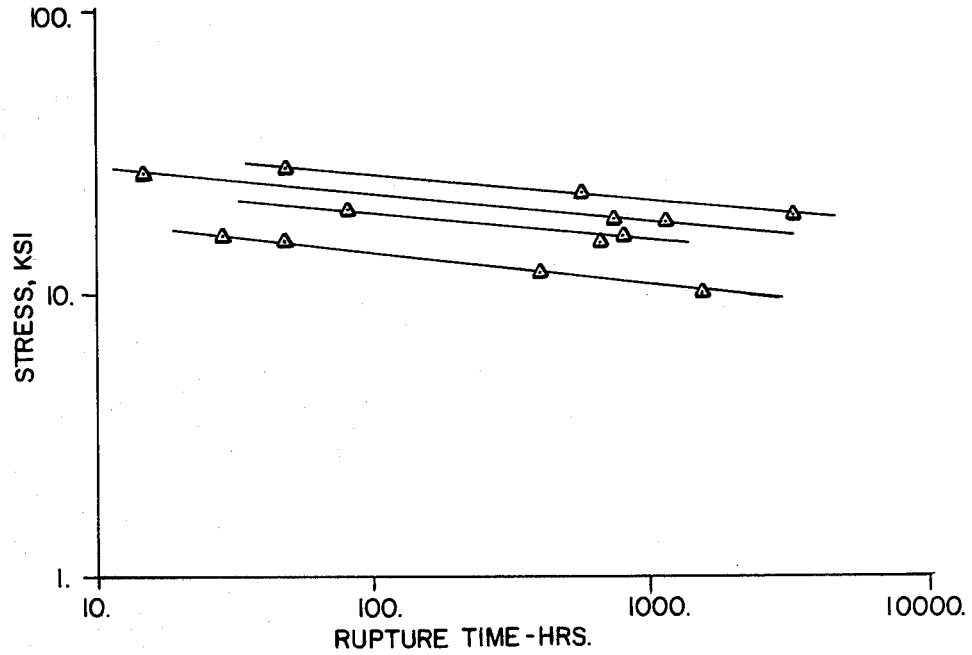
FIG. 1A is a graph showing the creep resistance of the alloy according to this invention.

Examination of as cast surfaces produced with a Wheaton alloy that were in contact with the mold during solidification revealed a surface phenomenon termed metal-mold reaction, manifesting itself as oxidation of MC-carbides. In FIG. 1 the depth of the oxidation attack of the MC carbides is plotted vertically as a function of section size, plotted horizontally, of various styled vane segments for a constant zirconium level. With the data on hand, as a first approximation of the depth of attack seem to follow $$D = K \cdot t^x$$

where K is a constant and $t$ is the section size. FIG. 1 shows K and $x$ for the two zirconium ranges. The data are for standard mold systems consisting of approximately 70% $SiO_2$, 15% $ZrO_2$ with the balance of $Al_2O_3$ bound together by a coloidal silicate binder.

The alloy of this invention has the following composition in weight percent:

Carbon 0.55 to 0.65
Chromium 22.5 to 24.25
Nickel 9.0 to 11.0
Titanium 0.15 to 0.50
Tungsten 6.5 to 7.5
Tantalum 3.0 to 4.0
Iron 1.5 maximum
Boron 0.010 maximum
Silicon 0.40 maximum
Manganese 0.10 maximum
Cobalt Balance The zirconium is maintained at a minimum and should not exceed 0.05%. To achieve this object the tungsten and tantalum used in forming the alloy is so produced as to minimize the zirconium.

An improved alloy from the standpoint of creep-rupture resistance is achieved by including a small but effective quantity of aluminum. This was demonstrated by producing heats with different contents of aluminum and testing specimens of these heats. The starting heat had the following composition in weight percent:

Carbon 0.57
Chromium 23.35
Nickel 10.45
Titanium 0.19
Tungsten 7.15
Tantalum 3.78
Iron .24
Zirconium 0.03
Aluminum 0.03
Cobalt Balance The other heats had respectively, in weight percent of aluminum .1, .2, and .5. The specimens were ruptured under different static stress in thousands of pounds per square inch, KSI, at different temperatures and the following data was derived: time to rupture, tr, percent elongation E, reduction in area RA. The following Table I shows the results:

TABLE I

| Test Conditions | | | I | II | III | IV |
|---|---|---|---|---|---|---|
| Temperature | Stress KSI | | original heat | OH with .1A1 | OH with .2A1 | OH with .5A1 |
| | | tr | 12.9 | 17.1 | 28.6 | 30.6 |
| | | E | 9.8 | 10.0 | 3.5 | 5.3 |
| 2000° F | 9 | RA | 14.0 | 28.4 | 6.5 | 8.0 |
| 1800° F | 16 | tr | 34.8 | 50.7 | 68.3 | 65.8 |
| | | E | 7.1 | 11.5 | 8.7 | 6.1 |
| | | RA | 21.1 | 21.9 | 16.8 | 12.3 |
| 1650° F | 27 | tr | 15.2 | 6.6 | 18.0 | 27.1 |
| | | E | 18.0 | 19.1 | 15.3 | 14.2 |
| | | RA | 30.0 | 30.0 | 31.0 | 18.8 |
| 1650° F | 18 | tr | 756.0 | 1344.2 | 1246.5 | 1260.1 |
| | | E | 2.6 | 5.9 | 4.9 | 4.6 |
| | | RA | 2.7 | 13.7 | 9.9 | 9.5 |
| 1800° F | 10 | tr | 589.0 | 1137.7 | 1349.2 | 1374.6 |
| | | E | 1.4 | 2.3 | 1.9 | 2.4 |
| | | RA | 2.7 | 2.2 | 0.5 | 2.4 |

Table I shows that the creep-rupture resistance increases as the aluminum content is increased. However, as measured by the percent elongation and reduction in area, the ductility decreases. A compromise is therefore necessary. It was concluded that high creep-rupture resistance and tolerable ductility is achieved with the aluminum content between 0.10% and 0.25% by weight.

Figure 2:
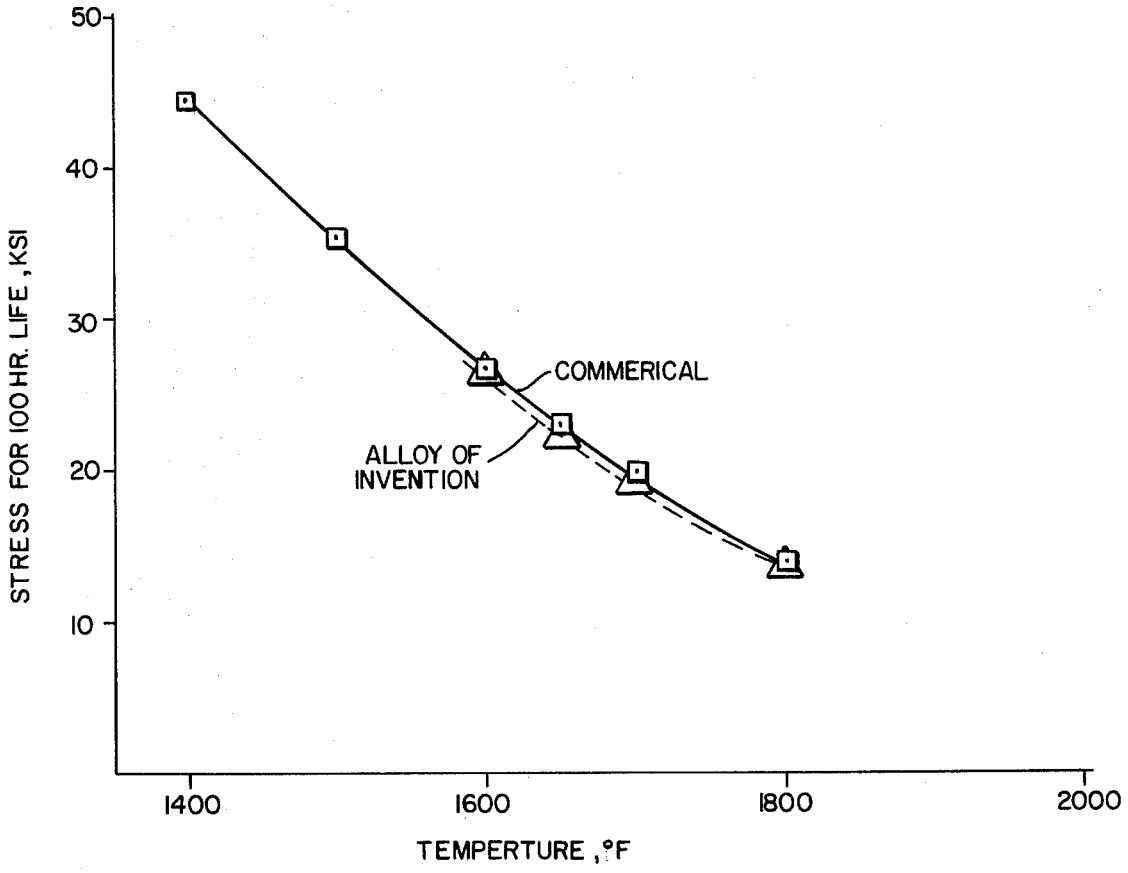
FIG. 2 is a graph in which the creep resistance of the alloy according to this invention is compared with the creep resistance of a commercial specimen of the Wheaton alloy.

An alloy having the following composition in weight percent is provided in accordance with this invention:

Carbon 0.55 to 0.65
Chromium 22.5 to 24.25
Nickel 9.0 to 11.0
Titanium 0.15 to 0.50
Tungsten 6.5 to 7.5
Tantalum 3.0 to 4.0
Aluminum 0.10 to 0.25
Iron 1.5 maximum
Boron 0.010 maximum
Silicon 0.40 maximum
Manganese 0.10 maximum
Cobalt Balance The graphs of FIGS. 1 and 2 were produced with a heat having the following composition:

Carbon 0.61
Chromium 23.64
Nickel 10.17
Titanium 0.26
Tungsten 6.83
Tantalum 3.70
Aluminum 0.010
Zirconium 0.03
Iron 0.35
Boron 0.009
Silicon 0.16
Manganese < 0.1
Bismuth < .3 ppm
Lead 1 ppm
Silver < 5 ppm
Sulfur 0.003
Colbalt - Balance The graph of FIG. 1 shows that this alloy has high creep-rupture resistance. In this graph static stress in thousands of pounds per square inch is plotted vertically and time-to-rupture horizontally. The curves were produced at different temperatures as indicated. At 1800° F and 10000 psi the time-to-rupture was 3000 hours at 1700° F and 15000 psi the time-to-rupture was 1000 hours.

In FIG. 2 the static stress, in thousands of pounds per square inch, necessary to produce rupture in 100 hours is plotted vertically and temperature in °F horizontally. The full-line curve was produced for a commercial Wheaton alloy and the broken-line curve for the alloy, according to this invention, having the same composition as the alloy used to produce FIG. 1. The curves reveal that the alloy according to this invention has about the same resistance to rupture as the Wheaton alloy.

Figure 5D:
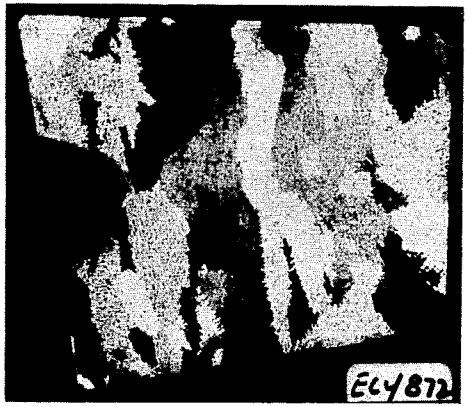
FIGS. 5A, B, C, D, are grain photographs, about 5 magnification, of cross sections of an airfoil or vane cast of the alloy according to this invention.
Figure 5B:
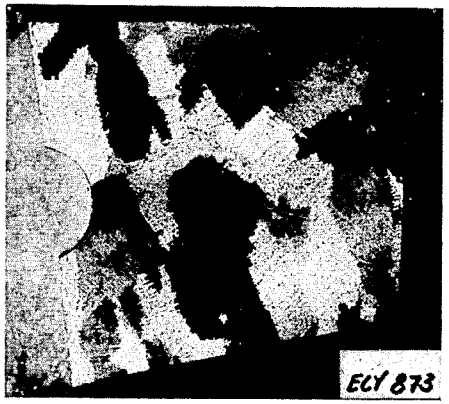
Figure 5C:
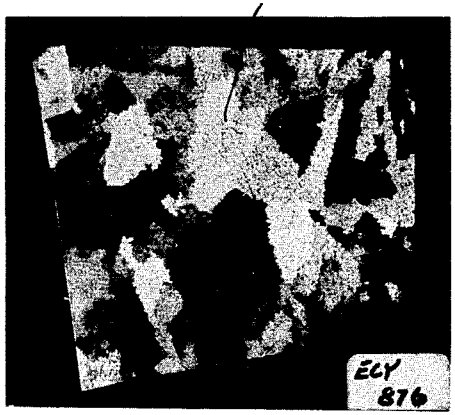
Figure 5A:
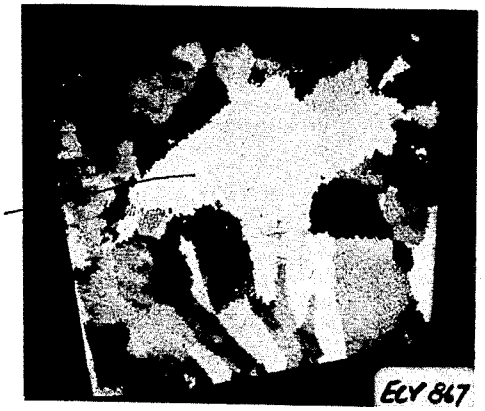

FIGS. 5A and 5B are sections through vanes produced at the same molding temperature but at different superheat temperatures, FIG. 5B at a higher superheat temperature than FIG. 5A. FIG. 5C and 5B are through vanes produced at the same superheat temperatures as FIGS. 5A and 5B respectively but at a higher molding temperature. FIGS. 6A, 6B, 6C, and 6D are sections through vanes produced at the same superheat and molding temperatures as 5A, 5B, 5C and 5D respectively. FIGS. 5A through 5D show larger grains as extending in both directions while FIGS. 6A through 6D show small columns grains G1.

Figure 7:
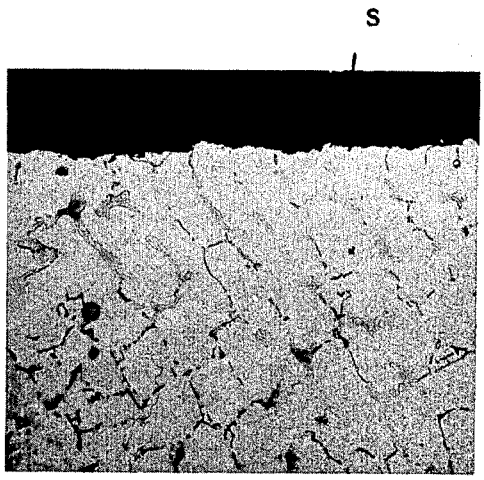
FIG. 7 is a photomicrograph, 200 magnification, of the section shown in FIG. 5C.
Figure 8:
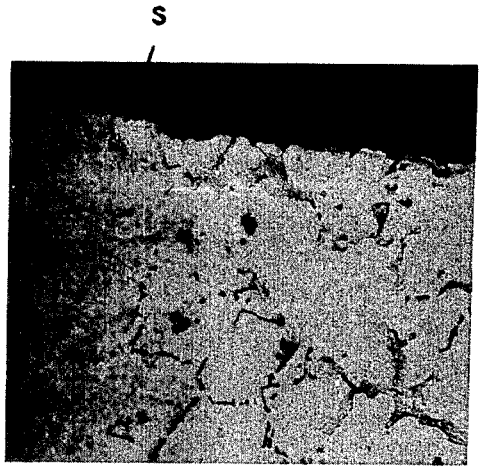
FIG. 8 is a photomicrograph, 200 magnification, of the section shown in FIG. 5D.
Figure 9:
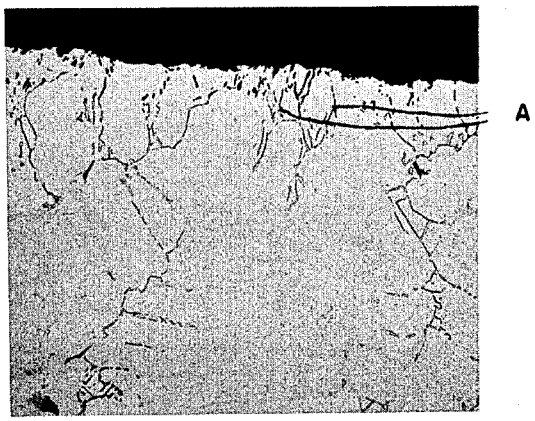
FIGS. 9 and 10 are corresponding photomicrographs, 200 magnification, of the sections shown in FIGS. 6C and 6D respectively.
Figure 10:
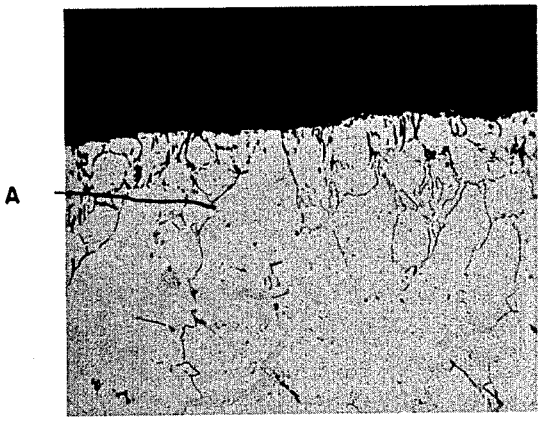

FIGS. 7 and 8 show no dendritic carbide oxide attack at the surfaces S while FIGS. 9 and 10 show such attack at A.

The grain photographs and the photo micrographs shown in FIGS. 5 through 10 compare the alloy according to the invention with a commercial Wheaton alloy. The composition of the alloy according to this invention is the same as the alloy from which FIGS. 1 and 2 were produced. For comparison this alloy composition is here reproduced in Table IA below, labelled ECY768, together with the Wheaton alloy labelled MAR M 509.

TABLE IA

| Heat No. | Mar M 509 | ECY 768 |
|---|---|---|
| | BC153 | 2A2807 |
| C | .57 w/o | .61 w/o |
| Cr | 23.4 | 23.64 |
| Ni | 10.0 | 10.17 |
| W | 6.76 | 6.83 |
| Fe | .24 | .35 |
| Ti | .20 | .26 |
| Ta | 3.55 | 3.70 |
| Al | | 0.10 |
| B | 0.006 | 0.009 |
| Zr | .32 | .03 |
| S | .005 | .003 |
| Mn | <.1 | <.1 |
| Si | .1 | .16 |
| Ag | 10 ppm | 5ppm |
| Pb | 25 ppm | 10 ppm |
| Co | Bal | Bal |

There follows a specification for producing stator blades in industrial gas turbines in the practice of this invention by investment casting of the alloy according to this invention.

1. Technological Requirements Composition: The composition of castings shall conform to the following percentages by weight methods by U.S. Government specifications or by other approved analytical methods.

| | |
|---|---|
| Chromium | 22.50 – 24.25 |
| Nickel | 9.0 – 11.0 |
| Titanium | 0.15 – 0.30 |
| Tungsten | 6.50 – 7.50 |
| Tanalum | 3.00 – 4.00 |

-continued

| | |
|---|---|
| Carbon | 0.55 – 0.65 |
| Zirconium, Max. | 0.050 |
| Boron, Max. | 0.010 |
| Iron, Max. | 1.50 |
| Silicon, Max. | 0.40 |
| Manganese, Max. | 0.10 |
| Sulfur, Max. | 0.010 |
| Silver, Max. | 0.0010 |
| Lead, Max. | 0.0025 |
| Bismuth, Max. | 0.010 |
| Aluminum, Max. | 0.05 |
| | add up to .15 |
| Selenium, Max. | 0.01 |
| Cobalt | Reminder |

2. Process: The castings shall be cast by the investment casting method. Castings shall be produced from master heat ingots, remelted and poured under vacuum without loss of vacuum between melting and pouring.

3. Master Heats: A master heat is metal of a single furnace charge of less than 12,000 lbs. melted and cast into ingots under vacuum. Reverts (i.e. gates, sprues, risers, rejected castings) shall not be remelted directly for pouring of castings. They may be used in preparation of master heats. Sample castings shall be furnished from all new or revised patterns or molds where patterns are not used, and work shall not proceed on production castings until written approval is obtained.

4. The same technique for production casting shall be used as is finally developed for the sample castings.

5. Inspection Standards: Sample castings shall be complete to production requirements of dimensional, material and quality standards.

6. Any work performed internally to determine the acceptability of a part may be on a two piece basis. Upon satisfactory production of internal samples of above, approximately 6 to 10 stators total shall be completed per production methods and requirements and submitted for sample approval.

7. Internal inspection reports and red-line layouts or other dimensional inspection reports may be reviewed for approval of samples.

8. All sample stators shall be macroetched all over for grain size and submitted in the etched condition.

9. For sample acceptance the following process information shall be documented and made available. Source of master heat, mold configuration and gating drawings, or photographs; mold preparation; types of materials; method and type of grain size control; mold preheat temperature including min/max and time; core preparation and core removal process; furnace type and size for melting the alloy and cast the segment; vacuum level when pouring min/max; leak rate; type and preparation of refractory; preparation and size of charge; rate of melt-down; super-heat temperature max/min and max time; pouring temperature, min/max; rate of pour; mold cooling parameters after pouring. The certified test report shall contain all information as required.

10. Grain Size, Shape and Distribution: All castings shall have substantially uniform equiaxed grains without pronounced segregation of fine and coarse areas. Actual grain size values and method of determining grain size shall be in accordance with standards and procedures agreed upon. The range of acceptable and unacceptable grain size for each part will be documented. Grain size control shall be monitored per acceptance standard requirements and grain size photographs shall be submitted.

Figure 3:
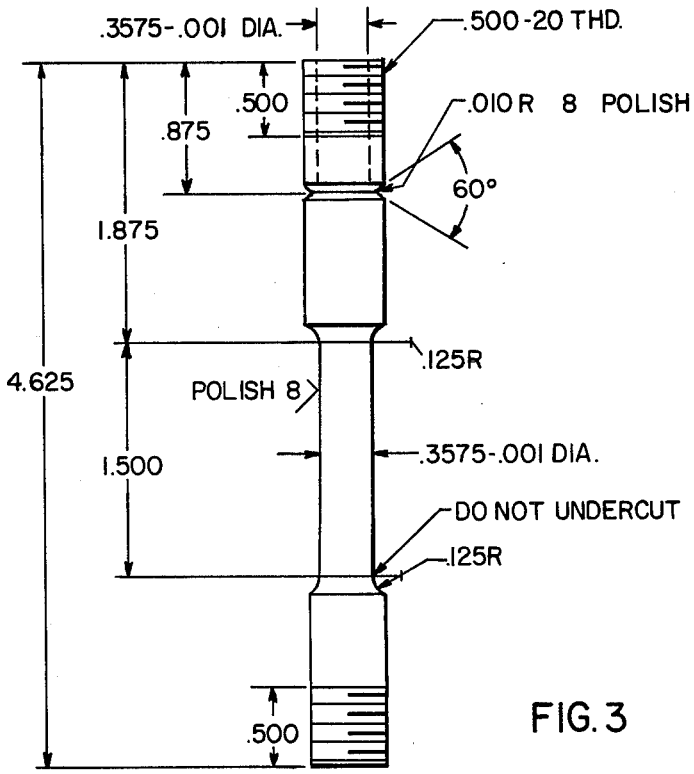
FIG. 3 is a view in side elevation showing the dimensions of creep-rupture specimens used in evaluating the creep resistance of the alloy according to this invention.

11. Specimens Cast Separately (SCS): For each master heat used test specimens shall be cast and and processed per techniques agreed upon. SCS-tension test specimens shall be of standard proportions in accordance with ASTM E8. Diameter in the reduced section shall be .375 inch. SCS-stress rupture and creep rupture specimens shall be in accordance to FIG. 3 and tested per ASTM E 139. Specimens may be cast to size or cast oversize and subsequently machined.

12. Specimens Machined from Blades (SMB): For each master heat used for blades test specimens shall be machined from the cast on test block. The specimens shall be of standard proportion in accordance with ASTM E 8 except as modified in ASTM E 139. Minimum gauge diameter shall be 0.250 inch.

13. Properties shall be determined on specimens in the as cast condition.

14. Tensile Properties: Tension test specimens from each master heat shall be tested in accordance with ASTM E 8 and shall meet the requirements in Table II below.

TABLE II

| | |
|---|---|
| Test Temperature, ° F | 72 |
| 0.2% offset yield strength, min., ksi | 70 |
| Ultimate tensile strength, min., ksi | 100 |
| Elongation in 4D, min., percent | 2.5 |
| Reduction of Area, percent | For Info. Only |

15. Stress Rupture and Creep Rupture Properties: Determined in accordance with ASTM E 139 on specimens manufactured per paragraphs 11 and 12 above. The test shall be as and shall meet the conditions, set forth in Tables III, IV and V below.

TABLE III

| | Type of Specimen | |
|---|---|---|
| Stress Rupture Test: | SCS (11) | SMB (12) |
| Temperature, ° F | 2000 | 2000 |
| Stress, ksi | 9 | 9 |
| Time to rupture, hrs., min. | 16 | 16 |
| Elongation in 4D, percent min. | 6 | 6 |
| Reduction of Area, percent min. | 8 | 8 |

TABLE IV

| | Type of Specimen | |
|---|---|---|
| Creep Rupure Test: | SCS (11) | SMB (12) |
| Temperature, ° F | 1800 | 1800 |
| Stress, ksi | 16 | 16 |
| Time to rupture, hrs., min. | 54 | 54 |
| Elongation in 4D, percent min. | 6 | 6 |
| Reduction of Area, percent min. | 13 | 13 |

TABLE V

| | | |
|---|---|---|
| Creep Test: | | |
| Temperature, ° F | 1650 | 1650 |
| Stress, ksi | 18 | 18 |
| Max. total strain in 50 hrs., percent min. | 0.45 | 0.45 |
| Max. total strain in 100 hrs. | For Info. Only | |

16. If any test piece prepared in accordance with paragraphs 11 and 12 fail to meet the requirements of paragraphs 11, 12, 13, 14, 15 two further test pieces for each test that failed shall be selected from the same heat. Test pieces prepared from both these further samples shall meet the requirements specified, otherwise the cast lot shall be subject to rejection.

17. If any test piece fails because of casting defects in the specimen, a further test sample shall be selected from the same melt and tested in accordance with paragraphs 11 through 15.

18. Hardness: 24-34 HRC determined per ASTM E 18.

Figure 4:
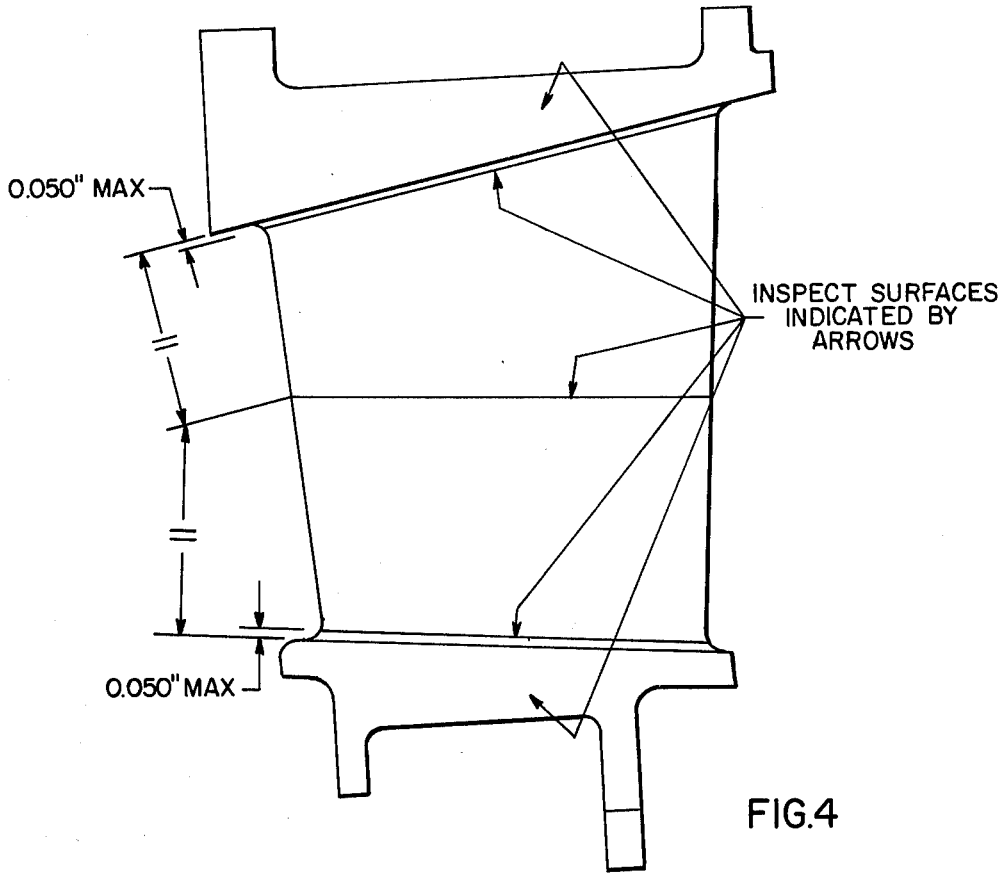

19. Metallographic Examination: Porosity, intergranular and carbide selected metallographic specimens removed from representative castings from each master heat and per requirements of paragraph 25 below. Sectioning and inspection of blades for the acceptance test shall be executed as shown in FIG. 4. The frequency for production control test pieces shall be agreed upon. The specimens in as cast condition shall be examined for intergranular attack from core removal processes and/or grain etching, and for internal carbide oxidation (I.C.O.) from metal-mold reactions on external and internal surfaces. Microporosity measurements shall be established.

The following requirements shall be met:
Intergranular attack: 0.0005 inch
Internal Carbide Oxidation (ICO): 0.0005 inch
Microporosity:
Method: Automatic Quantitative Image Analyzer
Magnification: 100X (0.040 inch × 0.040 inch field area)
Number of fields: 100
Average Area Porosity in 100 fields: 0.2%
Max. Area Porosity in any one field: 2.0%

20. Castings shall be uniform in quality and condition, sound, smooth, clean and free from foreign materials and from internal and external imperfections detrimental to the fabrication or performance of the parts. Unless otherwise specified metallic shot or grit shall not be used for cleaning.

21. Unless otherwise specified, all castings shall be subjected to Zyglo Pentrex fluorescent penetrant examination. Castings shall be prepared for inspection either by blasting with 80 mesh or finer grit or by means of suitable etchants so as to provide a surface free of smeared metal or other material that will prevent proper penetration of inspection materials into imperfections. Unless otherwise specified, metallic shot or grit shall not be used for cleaning.

22. The technique for radiographic inspection shall be as agreed to.

23. Inspection standards and procedures for visual fluorescent penetrant, radiographic inspection shall be defined in relevant literature.

24. The castings may be repaired by welding as specified on applicable engineering document. Prior to any repair welding attempt, the defects shall be completely removed and the dimension of the cavities be documented on an Engineering Appraisal Notice (EAN) to be submitted.

25. For production quality control all stator vane segments shall contain sufficient cast on test material of size, shape and in location as specified on relevant Engineering Drawings. The cast on material shall be removed from the casting and identified per segment serial number and to be stored for future reference or tested by the manufacturer. Specimens from the cast on material shall be tested and meet requirements as specified in paragraphs 11 through 15 and 19, at a frequency specified.

26. Finish: The castings shall be clean and free from blow holes, porosity, slag, oxides, cracks, seams, parting lines and other injurious imperfections which will materially affect the operations of the part or indicate use of inferior metal or castings technique. The surface finish shall be as specified on the drawing.

While preferred embodiments of this invention have been disclosed herein, many modifications thereof are feasible. This invention is not to be restricted except insofar as is necessitated by the spirit of the prior art.

We claim:

1. A creep-resistance cobalt base alloy for use in gas turbine engines consisting essentially of the following elements in weight percent:

| | | | |
|---|---|---|---|
| Carbon | 0.55 | to | 0.65 |
| Chromium | 22.5 | to | 24.25 |
| Nickel | 9.0 | to | 11.0 |
| Titanium | 0.15 | to | 0.50 |
| Tungsten | 6.5 | to | 7.5 |
| Tantalum | 3.0 | to | 4.0 |
| Aluminum | 0.10 | to | 0.2 |
| Iron | 1.5 | maximum | |
| Boron | 0.010 | maximum | |
| Silicon | 0.40 | maximum | |
| Manganese | 0.10 | maximum | |
| Zirconium | 0.050 | maximum | |
| Cobalt | balance. | —. | |

* * * * *